US007256377B2

(12) United States Patent
Alton et al.

(10) Patent No.: US 7,256,377 B2
(45) Date of Patent: Aug. 14, 2007

(54) COUPLED-WAVEGUIDE MICROWAVE APPLICATOR FOR UNIFORM PROCESSING

(75) Inventors: William J. Alton, Pepperell, MA (US); Paul M. C. Alton, Mason, NH (US)

(73) Assignee: The Ferrite Company, Inc., Nashua, NH (US)

( * ) Notice: Subject to any disclaimer, the term of this patent is extended or adjusted under 35 U.S.C. 154(b) by 0 days.

(21) Appl. No.: 10/846,345

(22) Filed: May 14, 2004

(65) Prior Publication Data

US 2004/0238533 A1 Dec. 2, 2004

Related U.S. Application Data

(60) Provisional application No. 60/471,399, filed on May 16, 2003.

(51) Int. Cl.
*H05B 6/78* (2006.01)
*H05B 6/64* (2006.01)

(52) U.S. Cl. ..... 219/701; 219/678

(58) Field of Classification Search ..... 219/701, 219/700, 698, 678, 684, 656, 663, 428, 779
See application file for complete search history.

(56) References Cited

U.S. PATENT DOCUMENTS

| | | | | |
|---|---|---|---|---|
| 3,549,848 | A * | 12/1970 | Williams | 219/700 |
| 3,795,183 | A * | 3/1974 | Roth et al. | 99/353 |
| 5,457,303 | A * | 10/1995 | Shute et al. | 219/700 |
| 6,201,224 | B1 * | 3/2001 | Churchland et al. | 219/678 |
| 6,396,034 | B2 * | 5/2002 | Drozd et al. | 219/693 |
| 6,583,394 | B2 * | 6/2003 | Araya et al. | 219/685 |
| 6,590,191 | B2 * | 7/2003 | Drozd et al. | 219/695 |
| 6,863,913 | B1 * | 3/2005 | Navin et al. | 426/231 |

* cited by examiner

*Primary Examiner*—Daniel Robinson
(74) *Attorney, Agent, or Firm*—Hamilton, Brook, Smith & Reynolds, P.C.

(57) ABSTRACT

An apparatus providing uniform microwave processing of products especially those that are likely to absorb microwave energy such as meat and the like. The apparatus uses at least a pair of complimentary processing waveguides. The waveguides are offset along at least one axis thereof so that the energy coupled to the product when traveling through a first waveguide section is presented with a complimentary or mirror image of the field variation applied to the product when traveling in the second waveguide. Energy may be fed to the elongated waveguides through a broad open wall or a wall having narrow openings. Coupling values can therefore be adjusted to transfer a higher percentage of energy in the feeder waveguide as microwaves propagate but then are diminished by a previous coupling section.

10 Claims, 6 Drawing Sheets

COUPLED-WAVEGUIDE MICROWAVE APPLICATOR FOR UNIFORM PROCESSING

RELATED APPLICATION

This application claims the benefit of U.S. Provisional Application No. 60/471,399, filed on May 16, 2003. The entire teachings of the above application(s) are incorporated herein by reference.

BACKGROUND OF THE INVENTION

Volume processing of products with microwaves, such as needed for large scale cooking and the like, typically uses a transmission-type system in which the microwave energy and the product being processed travel in the same direction through the same waveguide. This was an early approach by Marshall, L. K., "High Frequency electromagnetic cooking apparatus", U.S. Pat. No. 2,495,415 (1950) and in Revercomb, H. E. and Watts, D. E., "Ultrahigh frequency dielectric heater", U.S. Pat. No. 2,467,230 (1949). Later refinements by Johnson, R. M., "Waveguide applicator and method", U.S. Pat. No. 3,597,565 (1971) and Bleakley, W. J., "Waveguide", U.S. Pat. No. 3,555,232 (1971), involved making changes to the shape of the waveguide to improve uniformity of product heating.

However, all of the processes involving coincident microwave energy and product flow have problems when the product to be processed has a high loss factor of microwave energy, and is of sufficient cross section to provide substantial attenuation of the energy in a short distance. This combination results in instantaneous heating where the product and microwave first co-mingle, and also results in substantial non uniform heating when the product is relatively wide and thick. Having the product flow opposite to the microwave flow does not substantially improve uniformity where the energy attenuation is such that most energy absorption occurs in a short distance. This distance can be as small as 6–12 inches in WR975 type waveguide at 915 MHz, for example.

Another commonly used waveguide applicator was first described by Stiefel, K. J., "Waveguide dielectric heating apparatus", U.S. Pat. No. 2,560,903 (1951). This moves the product through slots in the major waveguide walls in the direction of the microwave electric field, such that the product flow and microwave flow are at right angles. This device is most applicable to heating a thin sheet-like material and can be typically provides relatively low attenuation. Multiple passes through the waveguide, which can be configured in some form of meander line to expose the material to the microwave on multiple occasions, is required for efficient operation using this method.

Many refinements have also been described for processing of web-like materials lying in the electric field plane, such as Smith, F. J. and Silberman, K., "Method and Apparatus for drying sheet materials", U.S. Pat. No. 3,622,733 (1971); Gaon, D. and Wiedersatz, J., "Process for preparing fat free snack chips", U.S. Pat. No. 5,180,601 (1993); and Hedrick, et al. in "System for applying microwave energy in processing sheet like materials", European Patent Application No. 0667732A1 (1995). These techniques are all applicable to thin or web-like materials with relative low absorption.

SUMMARY OF THE INVENTION

For processing items that have high absorption, such as meat and the like, non-uniform microwave heating cannot be avoided. If the item is entirely located in a central E-field plane field, then when the product travels in the downstream of the microwaves it will be exposed to a much smaller microwave field. If the product is tilted so that the end first encountering the microwave field is in a lower field intensity area of the waveguide, and the downstream end is in a higher field intensity area then an improvement in uniformity can be obtained for thin sheets. However, this will not work for product of any appreciable thickness. Where the product is located away from the central area, there will be a difference in heating between the portion of the product closer to and furthest from the waveguide center line. Thus, the prior approaches have not been able to achieve uniform heating of such high absorption products.

In accordance with a preferred embodiment of the present invention processing of products, especially those having high microwave absorption characteristics, is provided by off-setting the position of a first processing waveguide section from the position of a second processing waveguide section. In particular, an apparatus can be arranged for continuous processing of a product with microwave energy by arranging a conveyer to pass through both a first microwave waveguide processor section and a second microwave waveguide processor section. The first and second microwave waveguide processor sections are offset along their longitudinal axes. This exposes the product to a first microwave energy profile when traveling through the first section and then to a second microwave energy profile when traveling through the second section. If the waveguides are relatively uniform in shape about the axis, the product will thus be exposed to complimentary energy.

In a preferred embodiment, for rectangular shaped waveguides, the offset is typically one half the width of a corresponding rectangular waveguide.

In a fundamental $TE_{10}$ mode, the electric field intensity within a rectangular waveguide varies as a sinusoidal function from zero at the side walls to a maximum at the center of the broadwall. Thus, power distribution across the waveguide is proportionate to a sine-squared function. By offsetting the two waveguide, approximately one half of the waveguide width, if approximately equal powers are applied to each processor section, then the product will be exposed to a uniform energy profile and to the sum of the same quantity in a sine squared and a cosine squared form.

In other embodiments, the waveguide sections may be fed by an adjacent longitudinal feeder waveguide section. The feeder waveguide section couples energy to the processor section via holes or openings formed in a common wall thereof. The holes are arranged to control and phase energy flow into the processing waveguide section.

An attenuation section may also be provided adjacent to the exit of the first waveguide and entrance of the second waveguide to avoid the creation of open and or standing waves within the processing sections at the joint thereof.

In further embodiments, a variable attenuator may be used to control the heating power applied to the product in the respective processing sections. This arrangement can be particularly advantageous where the product undergoes change in its characteristics as it is being processed by the first section. For example, as a meat product begins to be processed by the first section, its water content may be reduced. Thus, its ability to absorb heat energy is changed while it is being processed. Therefore, the amount of heat energy needed to be applied by the second section may need to be different from that applied by the first section in order to ensure overall uniform application of energy.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
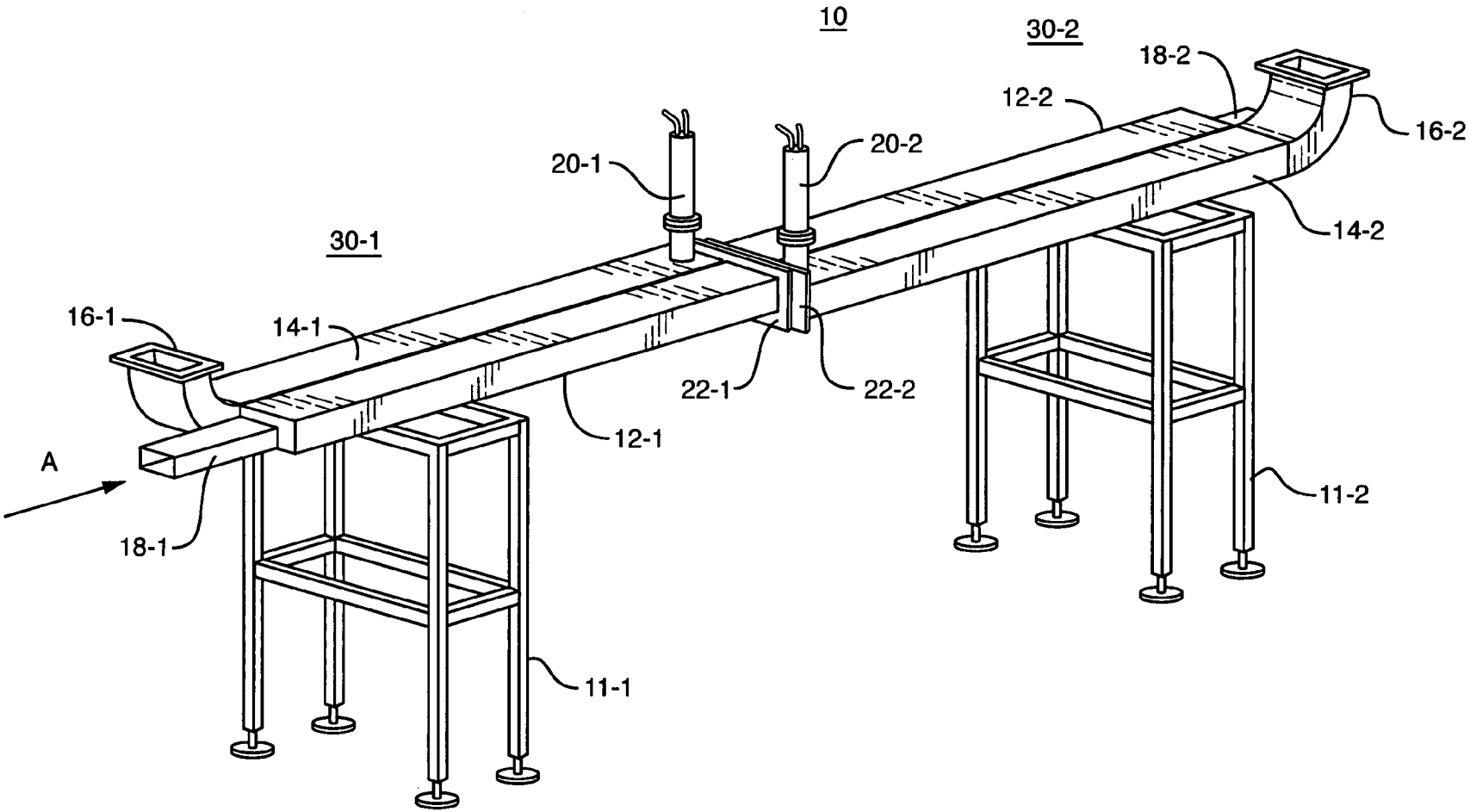
FIG. 1 is a perspective view of a microwave processing system.

FIG. 1 is a perspective view of a microwave processing system 10. The system 10 is intended for continuous processing of a product by microwave energy such as might be used to cook food or provide post-packaging pasteurizing. This particular invention is advantageous use when the product is of the type that has high absorption of microwave energy. Such products may for example, be meats, such as ham and the like, that have a high water and salt content.

The apparatus 10 includes two essentially identical but mirror image processing sections 30-1, 30-2. Section 30-1 consists of a processing waveguide section 12-1 which carries the product to the heated, and one or more microwave feeder waveguides 14-1 that carry microwave energy from a microwave power source (not shown). A feed 16-1 is used to couple the feeder waveguide 14-1 to the source. A conveyor-type arrangement (not shown in the drawings) allows product to be fed to a conveyer entrance 18-1 in the direction of arrow A. Product first travels through a first processing waveguide 12-1 before traveling through a second processing waveguide 12-2.

The components of the apparatus 10 may be supported by one or more stands 11-1, 11-2.

A mirror image element comprising a second processing section 12-2 is coupled to the output of the first section 16-1 but with a particular offset from the longitudinal (horizontal) axis. The particular arrangement of the offset, one-half waveguide width will be described in greater detail below. Water loads 20-1 may be provided to absorb microwave energy as it approaches the end of the first processing waveguide 12-1.

Figure 2:
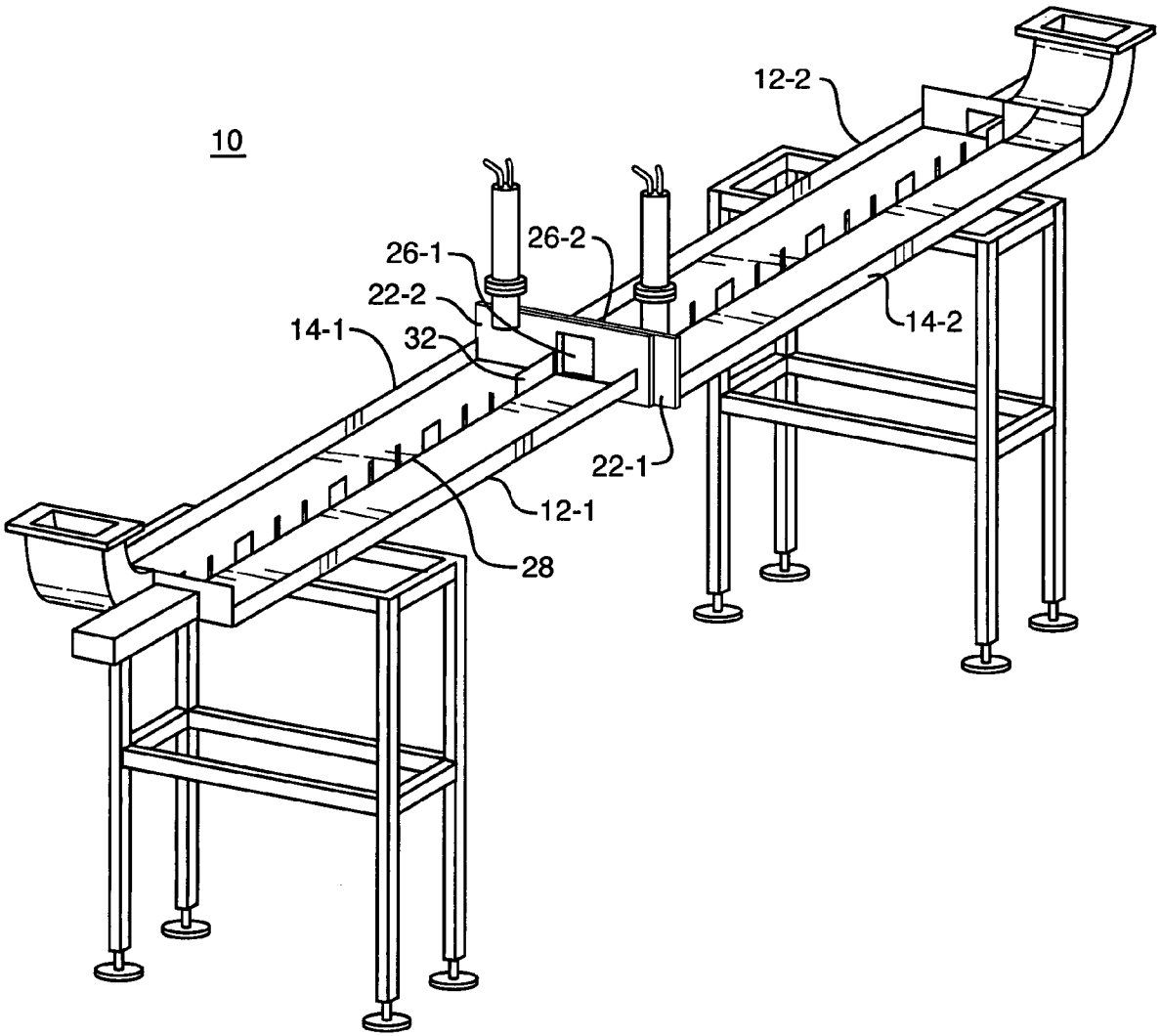
FIG. 2 is another view of the same processing system with the top cover removed, showing the internal product pathway and location of offset feed guides.
Figure 3:
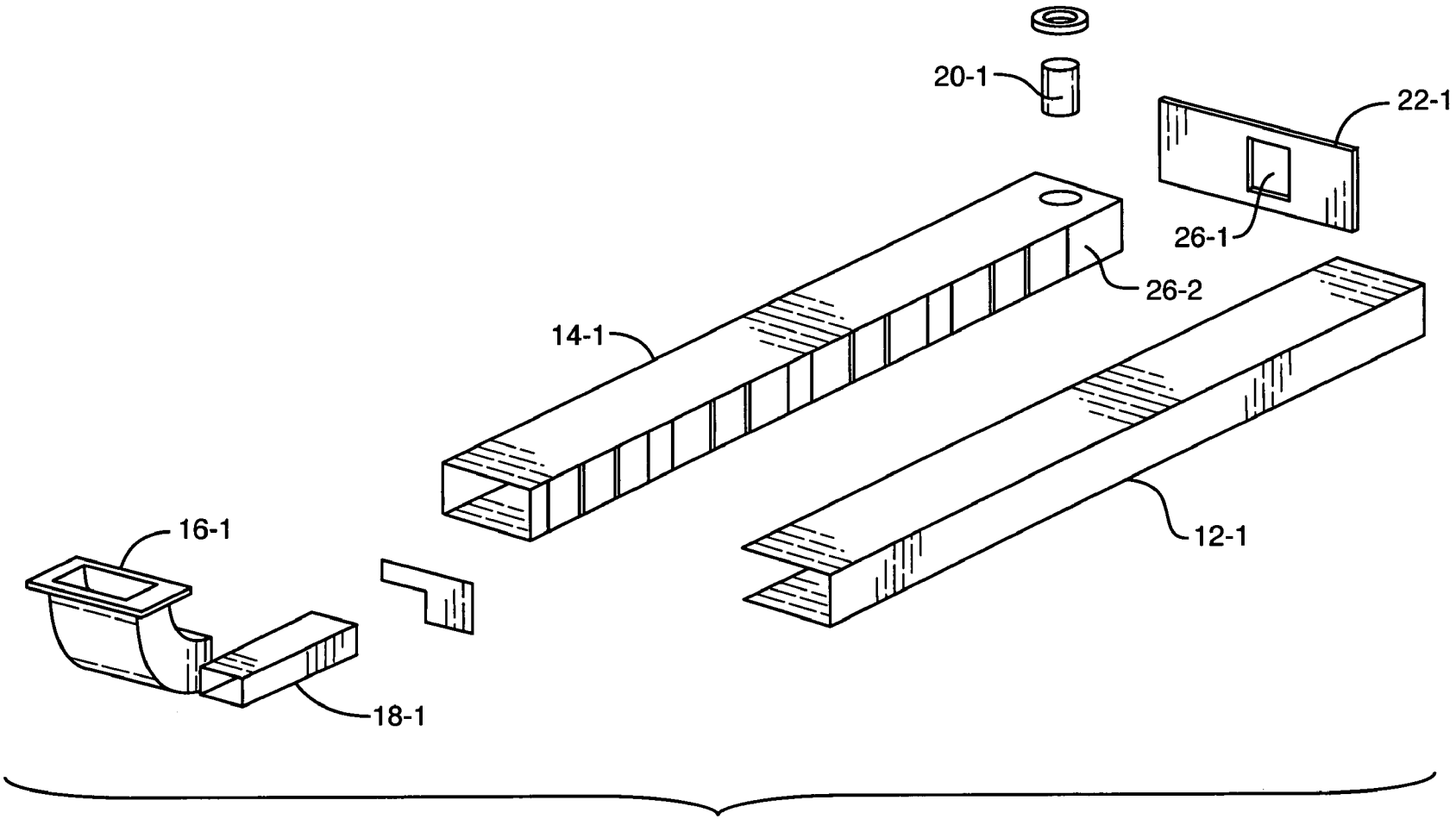
FIG. 3 is an exploded view of various components of one of the two identical feed guide processing units.

FIG. 2 is a similar view showing the apparatus 10 but with the top surfaces of the waveguides 12-1, 12-2 and 14-1, 14-2 removed. As can be seen, flanges 22-1 and 22-2 have a window 26-1, 26-2 cut in them so that the products may pass from the first section 12-1 towards the second section 12-2. A center wall section that divides the first processing waveguide 12-1 from the microwave feeder waveguide 14-1 also has holes or openings 28 cut into it along its length. The holes 28 are sized to control and phase the microwave energy flow in the processing waveguide 12-1. Similar holes 28 are formed between the second section 12-2 and its respective feeder 14.2. An attenuator section 32 may be provided adjacent the exit of the first section, near window 26-1 to assist with microwave attenuation before the product encounters a field shift imparted by the horizontal offset in the position of the first 12-1 and second section 12-2. This can avoid the creation of opens and or standing waves within the processing sections 12-1 and 12-2.

In the illustrated embodiment the product has an approximately four inch by one inch cross sectional dimension and the processing waveguide is approximately 9.75 inches by 4.875 inches in cross section.

More particularly now, the apparatus provides for improved uniform heating of a product, especially a product that is likely to absorb microwave energy such as meat, ham and the like as follows:

A. A processing waveguide 12-1 carries a product, and one or more microwave feeder waveguides 14-1 carry power from a microwave energy source. The processing 12 and feeder 14 waveguides share a common wall or walls, through which distributed coupling takes place, and all of these waveguides are sized for propagation in the fundamental $TE_{10}$ mode.

B. The coupling between the processing waveguide 12-1 and feeder waveguide 14-1 can take place through an adjacent wall, which may be a broad wall or narrow wall. See FIG. 2. The openings in the coupling wall can be adjusted to transfer a higher percentage of the energy from the feeder waveguide as the wave propagates and is diminished by previous coupling sections. This gives more uniform heating through the respective processing waveguide which aids final heating and uniformity.

C. The processing waveguide 12-1 and conveyor may be configured to carry the product either in the E-Plane or perpendicular to it.

D. The processing waveguide 12-1, when containing product, has rapid attenuation of energy coupled into it. Therefore, a sudden jog or offset in the waveguide can be built into the design with no risk of large power reflections or arcing. This offset is of preferentially half of the width of processing waveguide 12-1, and causes the product to be positioned in a mirror image of the original field variation in the processing waveguide. This provides an extremely uniform average heating effect for items of width equal or less that one half (½) the processor waveguide width. This required sudden displacement is much easier to accomplish, and at a lower cost, by using two (2) identical feeder/processor pairs configured to provide the offset when bolted together as in FIG. 1.

E. The inclusion of a waterload 20-1 in the end of each feeder waveguide 12-1 prevents excessive standing waves if the applicator is operated unloaded, lightly loaded, or at the start or end of processing. This aids processing uniformity and minimizes energy leak age from the input/output ends 18-1, 18-2.

Processing Details for Product Lying Over Areas of Differing Electric Field Strength in the Waveguide In a processing waveguide 12 operating in its fundamental $TE_{10}$ Mode, the electric field intensity varies as a sinusoidal function from zero at the side walls to a maximum at the center of the broadwall. This situation is depicted in FIG. 4 which shows a cross sectional view of the first section 12-1 (bottom drawing) and the second section 12-2 (top drawing).

In the cross sectional view, power distribution across the waveguide is thus proportional to a sine-squared function.

Figure 4:
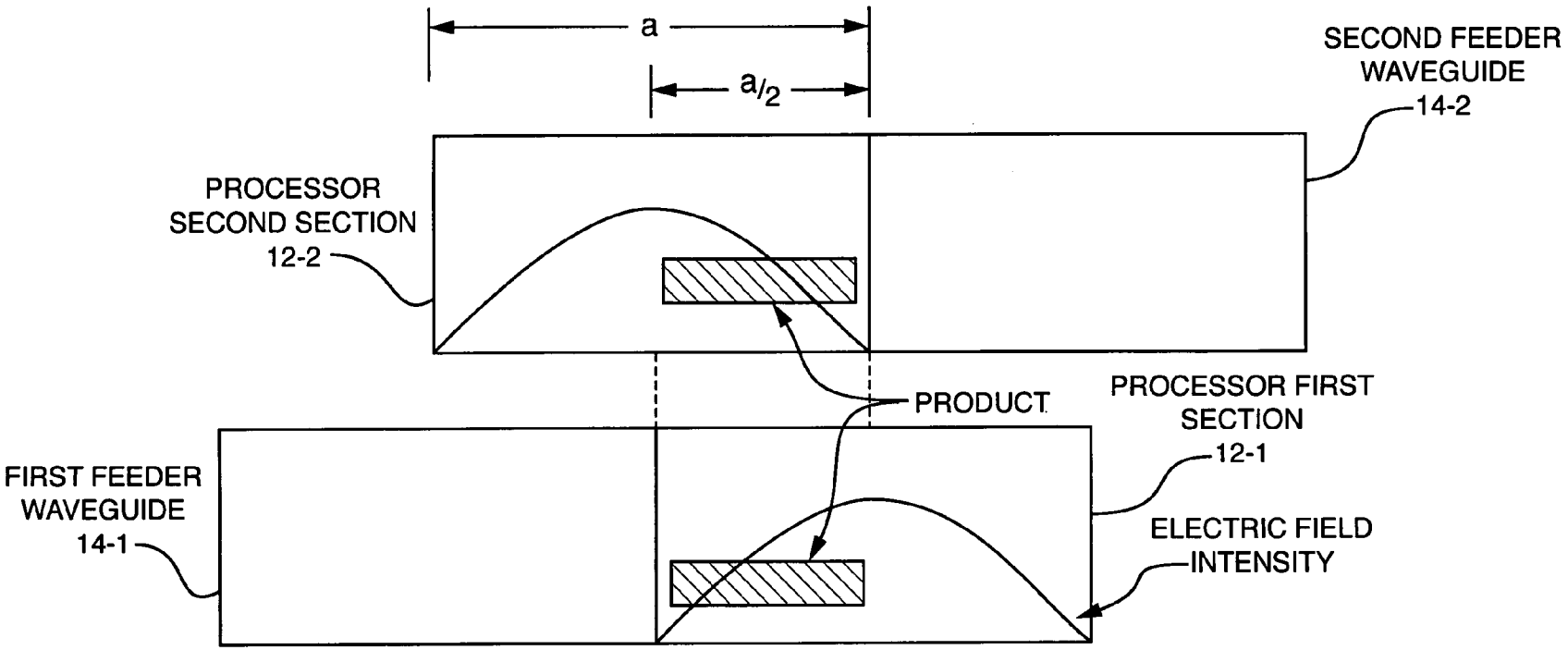
FIG. 4 is a schematic of a system with a one-half width waveguide displacement.

FIG. 4 also shows the product lying positioned within one half of the waveguide width. A sudden step in the processor waveguide when the product continues to travel in a straight line changes the electric field shape applied to the product from a sinusoidal function to a cosine function (A sine wave offset by 90° spatially).

The amount of heating of a product is proportional to the power distribution in the waveguide. If equal powers are applied to each processor section then, the heating of the product will be the sum of the same quantity in a sine squared and a cosine squared form.

From trigonometry:

$$\mathrm{SIN}^2 X + \mathrm{COS}^2 X = 1$$

therefore, complete cancellation of field variation effects on heating can be achieved for the fundamental $TE_{10}$ Mode by insuring that each section applies each heating power.

Where side wall coupling is used between the feeder and processing waveguides, the substantial removal of the common wall, to provide large amounts of coupling, results in an additional mode with a $TE_{10}$ type distribution over the double width. The half waveguide offset does not provide complete uniformity for this mode but does provide uniformity within about 14% for heating by this mode.

It should be understood that to accomplish uniform heating resulting from both sections 12-1 and 12-2 may require reducing or increasing the amount of applied power to each section respectively this is because the characteristics of the product may change as its being processed. For example, a section of meat that is entering the second section 12-2 is dryer than when it entered the first section 12-1. Thus, to ensure the same amount of heating energy is applied to the less-absorbed state may require adjusting the among of power applied to the second section 12-2. This can be achieved by either controlling the applied energy in the variable divider by changing the length of the sections 12-1 and 12-2.

Figure 5:
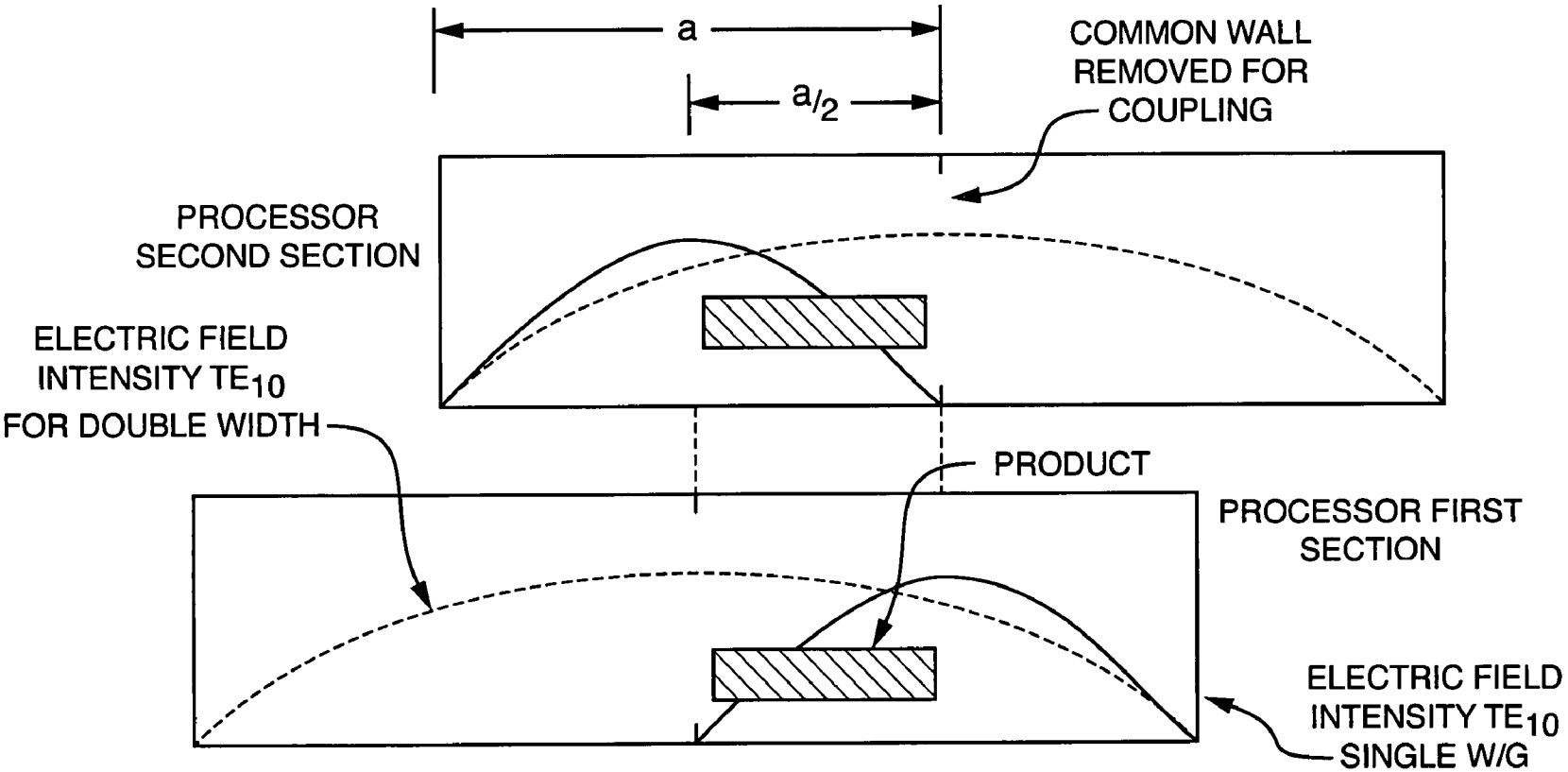
FIG. 5 shows the processing with the product in an H-plane.

This field distribution is depicted in FIG. 5. Since total heating is comprised of both single and double width $TE_{10}$ fields, the overall uniformity will be approximately 7%. This averaging effect can obviously apply whether the product is essentially in the E-direction (shown in FIG. 6) or H-field direction (perpendicular to the E-field). For foodstuffs which typically have high dielectric constants in excess of 40, if the product has appreciable thickness and substantially fills the waveguide B-dimension, the microwave electric field will be distorted. If the product is of a high loss and/or conductivity, the coupling effectiveness of the feeder waveguides can be reduced because the product itself acts as a wall.

Figure 6:
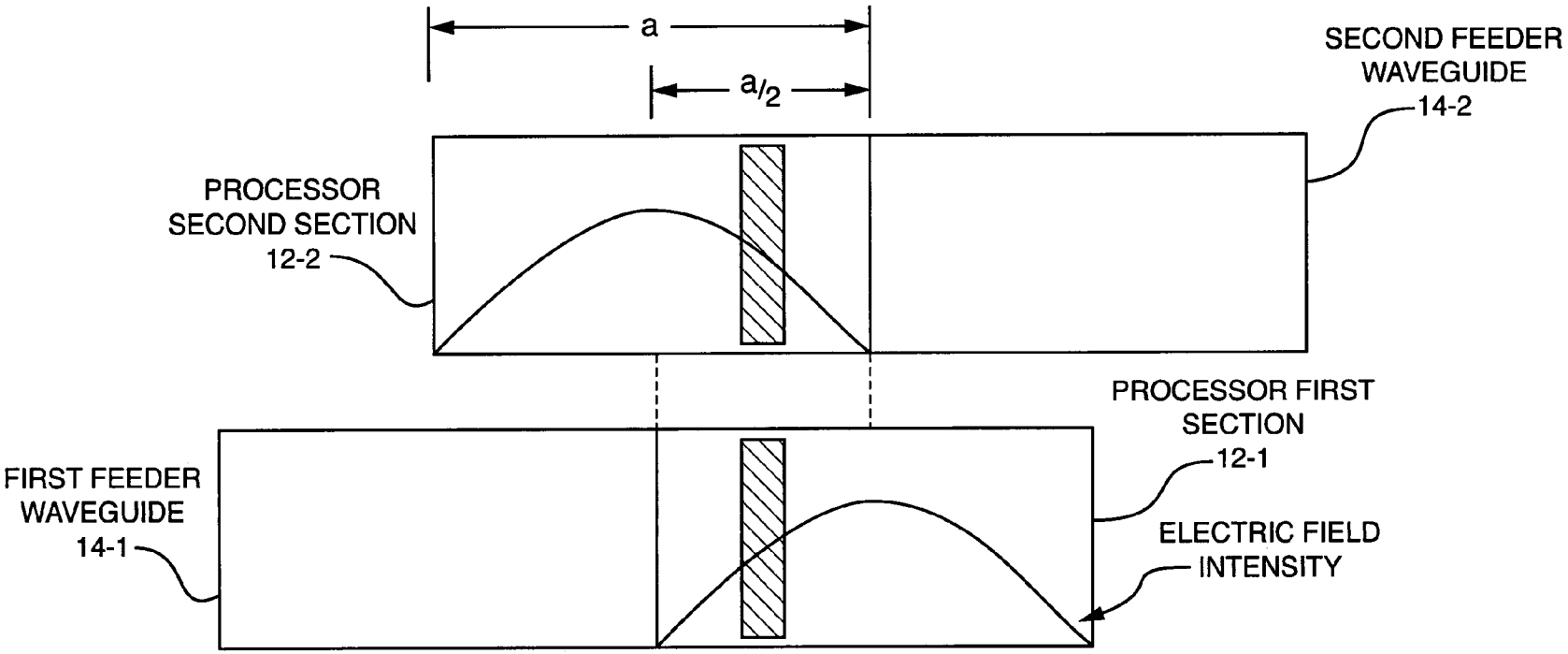
FIG. 6 shows the product located in the E-plane.

The limitations on the type of product which can be easily processed with the product lying in the E-plane causes the H-plane processor as shown in FIG. 6 to be the preferred approach. With the product lying in the H-plane as depicted in FIG. 6, there is only small distortion of the field by the product, and the coupling characteristics between the feeder and processor waveguides are not altered by the product. The product is transferred into and out of the processor on a belt through lengths of cutoff waveguide at each end of the unit.

While this invention has been particularly shown and described with references to preferred embodiments thereof, it will be understood by those skilled in the art that various changes in form and details may be made therein without departing from the scope of the invention encompassed by the appended claims.

What is claimed is:

1. An apparatus for continuous processing of a product with microwave energy comprising:

a conveyor for carrying the product through the apparatus;

a first microwave waveguide processing section, having a center longitudinal axis, and juxtaposed such that the conveyor carries the product there through;

a second microwave waveguide processing section, also having a center longitudinal axis, and also juxtaposed such that the conveyor carries the product there through, with the longitudinal axes of the first and second waveguide processing sections being offset in at least one direction, so that the product is exposed to a first microwave energy profile when traveling through the first section, and then exposed to a second microwave energy profile when traveling through the second section wherein the offset between the first and second processing sections is one half the width of the waveguides.

2. An apparatus as in claim 1 wherein the first and second processing sections are fed from respective feeder waveguides.

3. An apparatus as in claim 2 wherein the feeder waveguides are positioned along the longitudinal axes of the processing waveguides.

4. An apparatus as in claim 3 wherein holes are formed along an adjacent side wall between the feeder waveguide and the processing waveguide.

5. An apparatus as in claim 3 wherein an attenuator section is positioned adjacent to a point where the first processing section couples to the second processing section.

6. An apparatus as in claim 1 wherein the first and second processing sections operate in a $TE_{10}$ mode.

7. An apparatus for continuous processing of a product with microwave energy comprising:

a conveyor for carrying the product through the apparatus;

a first microwave waveguide processing section, having a center longitudinal axis, and juxtaposed such that the conveyor carries the product there through;

a second microwave waveguide processing section, also having a center longitudinal axis, and also juxtaposed such that the conveyor carries the product there through, with the longitudinal axes of the first and second waveguide processing sections being offset in at least one direction, so that the product is exposed to a first microwave energy profile when traveling through the first section, and then exposed to a second microwave energy profile when traveling through the second section, wherein the first and section processing sections have an identical cross sectional shape; and wherein the amount of microwave energy applied to the respective processing sections is adjusted so that the total energy applied to the product traveling in the first processing section is a mirror of the energy applied to the second processing section in a plane perpendicular to the longitudinal axes.

8. An apparatus as in claim 3 wherein a common wall is removed between the feeder waveguide and the processing waveguide.

9. An apparatus as in claim 7 wherein the first and second processing sections are oriented in an E-plane with respect to the product.

10. An apparatus as in claim 7 wherein the offset is in a direction perpendicular to the longitudinal axes of the first and second waveguide processing sections.

* * * * *